US007144232B2

(12) United States Patent
Locher

(10) Patent No.: US 7,144,232 B2
(45) Date of Patent: Dec. 5, 2006

(54) WATER WELL PUMP

(76) Inventor: Ben C. Locher, P.O. Box 563, Center Point, TX (US) 78010

( * ) Notice: Subject to any disclaimer, the term of this patent is extended or adjusted under 35 U.S.C. 154(b) by 594 days.

(21) Appl. No.: 10/726,239

(22) Filed: Dec. 2, 2003

(65) Prior Publication Data

US 2004/0131488 A1 Jul. 8, 2004

Related U.S. Application Data

(60) Provisional application No. 60/430,901, filed on Dec. 4, 2002.

(51) Int. Cl.
*F04B 39/10* (2006.01)

(52) U.S. Cl. ..... 417/555.2

(58) Field of Classification Search ..... 417/555.2, 417/554; 166/105, 107, 108, 109; 137/533.11, 137/533.13, 533

See application file for complete search history.

(56) References Cited

U.S. PATENT DOCUMENTS

| | | | |
|---|---|---|---|
| 35,577 | A | 6/1862 | Andrews |
| 118,496 | A | 5/1871 | Sparks |
| 188,229 | A | 3/1877 | Blakslee |
| 195,253 | A | 9/1877 | Barnes |
| 208,285 | A | 9/1878 | Beeman et al. |
| 215,951 | A | 5/1879 | May |
| 278,751 | A | 6/1883 | Shaw |
| 388,943 | A | 9/1888 | Woodward et al. |
| 530,350 | A | 12/1894 | Rosenkranz |
| 654,316 | A | 7/1900 | Lewis |
| 767,454 | A | 8/1904 | Taylor |
| 856,271 | A | 6/1907 | Linthicum |
| 955,024 | A | 4/1910 | Walker et al. |
| 974,342 | A | 11/1910 | Bell |
| 1,043,279 | A | 11/1912 | Wheeler |
| 1,043,568 | A | 11/1912 | Campbell |
| 1,097,955 | A | 5/1914 | Walinder |
| 1,163,535 | A | 12/1915 | Hazard |
| 1,165,105 | A | 12/1915 | Kraeer |
| 1,268,964 | A | 6/1918 | Hahn |
| 1,303,091 | A | 5/1919 | Mack |
| 1,313,359 | A | 8/1919 | Watson |
| 1,378,268 | A | 5/1921 | Northrup |
| 1,401,440 | A | 12/1921 | Provorse et al. |
| 1,409,450 | A | 3/1922 | Humason et al. |
| 1,423,935 | A | 7/1922 | Hopkins |
| 1,667,900 | A | 5/1923 | Muckelrath |

(Continued)

*Primary Examiner*—Anthony Stashick
*Assistant Examiner*—Vikansha Dwivedi
(74) *Attorney, Agent, or Firm*—Michelle Evans; Gunn & Lee, P.C.

(57) ABSTRACT

The present invention contains a one-way standing valve holder and a one-way traveling valve holder. Contained within a shell of the standing valve holder are a nipple at the upper end and an intake tube at the lower end. A piston rod extends down from the earth's surface to the traveling valve holder. At the lower end of the release tube is a piston. The piston end of the traveling valve holder is inserted into the nipple end of standing valve holder aligning the piston with piston stop. An elastic ball within the shell creates a one-way standing valve, and a hard ball within the piston creates a one-way traveling valve. Surface equipment connected to traveling valve holder is used to reciprocate the pump up and down opening and closing the one-way valves at alternating intervals. Water fills into the riser pipe and additional pumping allows collection of water.

20 Claims, 4 Drawing Sheets

U.S. PATENT DOCUMENTS

| | | | | |
|---|---|---|---|---|
| 1,483,369 | A | | 2/1924 | Miller |
| 1,488,987 | A | | 4/1924 | Hulsey |
| 1,493,267 | A | | 5/1924 | Kauffman |
| 1,499,690 | A | | 7/1924 | Pine et al. |
| 1,543,488 | A | | 6/1925 | Todd |
| 1,545,475 | A | | 7/1925 | Adams |
| 1,549,175 | A | | 8/1925 | Adams et al. |
| 1,574,922 | A | | 3/1926 | Nelson |
| 1,588,705 | A | | 6/1926 | Cope et al. |
| 1,623,239 | A | | 4/1927 | Galbreath |
| 1,674,815 | A | | 6/1928 | Barnhart |
| 1,697,431 | A | | 1/1929 | Martin |
| 1,714,434 | A | | 5/1929 | O'Bannon |
| 1,720,672 | A | | 7/1929 | Gray |
| 1,765,864 | A | | 7/1929 | Corey |
| 1,741,643 | A | | 12/1929 | McClure |
| 1,785,834 | A | | 12/1930 | Kilgore |
| 1,832,346 | A | | 11/1931 | Yerkes et al. |
| 1,840,432 | A | | 1/1932 | Bray |
| 1,865,912 | A | | 7/1932 | Horn |
| 1,867,933 | A | | 7/1932 | Hill |
| 2,002,140 | A | | 8/1932 | Dillon |
| 1,915,771 | A | | 6/1933 | Wickersham |
| 1,948,325 | A | | 2/1934 | Anderson et al. |
| 2,020,550 | A | | 11/1935 | Herrick |
| 2,138,002 | A | | 3/1936 | Hall |
| 2,039,621 | A | | 5/1936 | Behnke |
| 2,067,774 | A | | 1/1937 | Matthews et al. |
| 2,079,996 | A | | 5/1937 | Humason |
| 2,101,218 | A | | 12/1937 | Huff |
| 2,119,763 | A | | 6/1938 | Wilson |
| 2,141,957 | A | | 12/1938 | McDaniel |
| 2,166,612 | A | | 7/1939 | Scott |
| 2,169,703 | A | | 8/1939 | Mason |
| 2,171,479 | A | | 8/1939 | Nixon |
| 2,172,636 | A | | 9/1939 | Coberly |
| 2,178,822 | A | | 11/1939 | Upton et al. |
| 2,186,411 | A | | 1/1940 | Gurley et al. |
| 2,191,380 | A | * | 2/1940 | Hall ..... 417/434 |
| 2,194,154 | A | | 3/1940 | Scott |
| 2,215,558 | A | | 9/1940 | Miller |
| 2,221,204 | A | | 11/1940 | Santiago |
| 2,242,166 | A | | 5/1941 | Bennett |
| 2,245,501 | A | | 6/1941 | Richardson |
| 2,262,126 | A | | 11/1941 | Zehner |
| 2,262,128 | A | | 11/1941 | Zehner |
| 2,263,144 | A | | 11/1941 | Scott |
| 2,430,623 | A | | 3/1942 | Taylor, Jr. |
| 2,281,899 | A | | 5/1942 | White |
| 2,296,821 | A | | 9/1942 | Puls |
| 2,298,834 | A | | 10/1942 | Moore |
| 2,325,264 | A | * | 7/1943 | Eugen ..... 175/103 |
| 2,338,370 | A | | 1/1944 | Wilson |
| 2,350,973 | A | | 6/1944 | Brumleu et al. |
| 2,359,147 | A | * | 9/1944 | Eugen ..... 175/103 |
| 2,368,400 | A | | 1/1945 | Baker |
| 2,368,928 | A | | 2/1945 | King |
| 2,376,538 | A | | 5/1945 | Hardey |
| 2,384,173 | A | | 9/1945 | Johnston |
| 2,397,419 | A | | 3/1946 | Humason |
| 2,403,987 | A | | 7/1946 | Lewis |
| 2,423,653 | A | | 7/1947 | Lauman |
| 2,442,121 | A | | 5/1948 | Earley |
| 2,460,179 | A | | 1/1949 | Knott |
| 2,473,864 | A | | 6/1949 | Coberly |
| 2,497,348 | A | | 2/1950 | Ecker |
| 2,527,673 | A | | 10/1950 | Byram |
| 2,551,434 | A | | 5/1951 | Gray et al. |
| 2,562,584 | A | | 7/1951 | Soberg |
| 2,564,240 | A | | 8/1951 | Ware |
| 2,576,924 | A | | 12/1951 | Coberly |
| 2,583,111 | A | | 1/1952 | Mardis |
| 2,590,245 | A | | 3/1952 | Harbison |
| 2,605,712 | A | | 8/1952 | Davis et al. |
| 2,609,258 | A | | 9/1952 | Taylor, Jr. |
| 2,642,803 | A | | 6/1953 | Morris et al. |
| 2,646,128 | A | | 7/1953 | Reynolds |
| 2,653,545 | A | | 9/1953 | Dempsey et al. |
| 2,668,500 | A | | 2/1954 | Hoffer |
| 2,678,605 | A | | 5/1954 | Tappmeyer |
| 2,684,639 | A | | 7/1954 | Sutton |
| 2,689,535 | A | | 9/1954 | Martin |
| 2,715,441 | A | | 8/1955 | Bouvier |
| 2,748,712 | A | | 6/1956 | Sargent |
| 2,764,940 | A | | 10/1956 | Long |
| 2,800,859 | A | | 7/1957 | Chenault |
| 2,817,298 | A | | 12/1957 | Bloudoff |
| 2,818,022 | A | | 12/1957 | Kangas |
| 2,821,141 | A | | 1/1958 | Sargent |
| 2,821,933 | A | | 2/1958 | Brennan |
| 2,837,029 | A | | 6/1958 | Mohnkern |
| 2,874,436 | A | | 2/1959 | Allen |
| 2,885,968 | A | | 5/1959 | Wagner |
| 2,897,768 | A | | 8/1959 | Perry |
| 2,905,099 | A | | 9/1959 | Turner |
| 2,921,531 | A | | 1/1960 | Brennan et al. |
| 2,931,304 | A | | 4/1960 | Massey |
| 2,952,211 | A | | 9/1960 | Saner |
| 2,971,581 | A | | 2/1961 | Reglin |
| 2,982,355 | A | | 5/1961 | Rodgers |
| 3,015,280 | A | | 1/1962 | King |
| 3,040,811 | A | | 6/1962 | Pistole et al. |
| 3,064,580 | A | | 11/1962 | Calvert et al. |
| 3,066,738 | A | | 12/1962 | Myers |
| 3,069,824 | A | | 7/1963 | Brown |
| 3,123,007 | A | | 3/1964 | Orr |
| 3,132,568 | A | | 5/1964 | Strader |
| 3,136,265 | A | | 6/1964 | Chenault |
| 3,140,667 | A | | 7/1964 | Anderson et al. |
| 3,143,080 | A | | 8/1964 | Sutliff |
| 3,169,025 | A | | 2/1965 | Borah |
| 3,172,469 | A | | 3/1965 | Coberly et al. |
| 3,175,512 | A | | 3/1965 | Sutliff |
| 3,181,614 | A | | 5/1965 | Brown |
| 3,182,598 | A | | 5/1965 | McArthur et al. |
| 3,212,444 | A | | 10/1965 | Wells |
| 3,283,821 | A | | 11/1966 | Brown |
| 3,303,855 | A | | 2/1967 | Kurtz |
| 3,304,871 | A | | 2/1967 | Scroggins |
| 3,322,069 | A | | 5/1967 | Coberly |
| 3,414,057 | A | | 12/1968 | Harbison |
| 3,372,756 | A | | 3/1969 | Muckleroy |
| 3,436,084 | A | | 4/1969 | Courter |
| 3,453,963 | A | | 7/1969 | Roeder |
| 3,479,958 | A | | 11/1969 | Anderson et al. |
| 3,502,028 | A | | 3/1970 | Cooper |
| 3,517,741 | A | | 6/1970 | Roeder |
| 3,578,886 | A | | 5/1971 | Nino et al. |
| 3,586,464 | A | | 6/1971 | Crowe |
| 3,592,567 | A | | 7/1971 | Tolbert |
| 3,594,103 | A | | 7/1971 | Hills |
| 3,595,101 | A | | 7/1971 | Cooper |
| 3,614,984 | A | | 10/1971 | Schexnaider |
| 3,627,045 | A | | 12/1971 | Lexbourg |
| 3,653,786 | A | | 4/1972 | McArthur et al. |
| 3,687,202 | A | | 8/1972 | Young et al. |
| 3,697,194 | A | | 10/1972 | Holmes |
| 3,703,926 | A | | 11/1972 | Roeder |
| 3,765,482 | A | | 10/1973 | Harrison |
| 3,773,441 | A | | 11/1973 | Schertz |
| 3,777,626 | A | | 12/1973 | Schurenberg et al. |
| 3,865,516 | A | | 2/1975 | Roeder |
| 3,915,602 | A | | 10/1975 | Douglas |
| 3,918,845 | A | | 11/1975 | Heard |

3,941,510 A 3/1976 Morgan
3,945,774 A 3/1976 Doan
4,013,387 A 3/1977 Gage
4,026,661 A 5/1977 Roeder
4,040,486 A 8/1977 Kirkland, Jr.
4,049,365 A 9/1977 Sparks, Sr.
4,173,451 A 11/1979 Moore, Jr.
4,174,928 A 11/1979 Austin
4,190,113 A 2/1980 Harrison
4,214,854 A 7/1980 Roeder
4,234,294 A 11/1980 Jensen
4,260,020 A 4/1981 Nelson et al.
4,268,227 A 5/1981 Roeder
4,293,283 A 10/1981 Roeder
4,295,801 A 10/1981 Bennett
4,383,803 A 5/1983 Reese
4,390,326 A 6/1983 Callicoatte
4,403,919 A 9/1983 Stanton et al.
4,414,808 A 11/1983 Benson
4,462,763 A 7/1984 MacLeod
4,478,285 A 10/1984 Caldwell
4,480,685 A 11/1984 Gilbertson
4,493,383 A 1/1985 Williams et al.
4,516,479 A 5/1985 Vadasz
4,518,036 A 5/1985 Lefebvre et al.
4,540,348 A 9/1985 Soderberg
4,643,258 A 2/1987 Kime
4,661,052 A 4/1987 Ruhle
4,742,874 A 5/1988 Gullion
4,745,969 A 5/1988 Henderson
4,749,034 A 6/1988 Vandevier et al.
4,762,474 A 8/1988 Dartnall
4,773,834 A 9/1988 Saruwatari
4,778,355 A 10/1988 Holland
4,907,953 A 3/1990 Herbert et al.
4,949,758 A 8/1990 Bear
5,000,264 A 3/1991 Snider
5,040,608 A 8/1991 Doan
5,069,285 A 12/1991 Nuckols
5,088,745 A 2/1992 Peppiatt et al.
5,095,976 A 3/1992 Appleton
5,141,416 A 8/1992 Cognevich et al.
5,450,897 A 9/1995 Brown
5,494,102 A 2/1996 Schulte
5,639,227 A 6/1997 Mills
5,651,666 A 7/1997 Martin
5,752,814 A 5/1998 Starks et al.
5,915,475 A 6/1999 Wells et al.
6,099,274 A 8/2000 Conn
6,135,203 A 10/2000 McAnally
6,183,225 B1 2/2001 Thompson
6,273,690 B1 * 8/2001 Fischer et al. ..... 417/555.2

* cited by examiner

WATER WELL PUMP

This application claims priority to U.S. Provisional Application Ser. No. 60/430,901 filed Dec. 4, 2002.

BACKGROUND OF THE INVENTION

1. Field of the Invention

The present invention relates generally to a water well pump.

2. Background Information

All too often, water is taken for granted. Most well pumps last for years, and homeowners never give much thought to hard-working pumps that faithfully kick in every time a homeowner takes a shower, does laundry, or runs the dishwasher. Well pumps are the modern day equivalent of windmills, which were used to move water from one place to another over one hundred years ago. Like windmills, well pumps are particularly handy for irrigating crops, providing livestock with water, supplying water to remote locations, or for acting as heating and cooling mechanisms for geothermal systems. There are two general types of well pumps: submersible and jet.

About sixty percent of home wells in the U.S. use electric submersible pumps. Submersible well pumps are used underwater in wells. A small electric motor may be installed in the well shaft, usually below the pump itself, and an electric cable is attached to the motor. Piping is then fitted from the pump, through the length of the shaft and into the home. Submersible well pumps may be set hundreds of feet deep to the water in a well. When the pump is activated, the motor pushes water up out of the well. Submersible pumps are long cylinders usually three to five inches in diameter and two to four feet long. Well pumps may be powered by alternating current (AC), solar power, wind power, water power, or even manually.

One type of submersible pump is a reciprocating plunger well pump. Various designs of reciprocating plunger well pumps have been developed of the general type wherein the pump is mounted at the lower distal end of an elongated well tubing string and includes a reciprocating plunger or piston connected to an elongated rod extending to an actuating mechanism at the earth's surface. The pumps also include a cylinder in which the plunger reciprocates to displace fluid from a plunger cavity and is controlled by cavity inlet and discharge valves mounted on the cylinder and on the plunger, respectively.

In spite of the relatively highly developed state of the art in reciprocating plunger well pumps, certain problems in the operation of these pumps persist. In particular, when pumps are stopped, water hammer develops, which is an unwanted noisy and shaking condition of the pump. Further, the balls in many pumps are steel. Therefore, when the seat that the ball rests on becomes worn and damaged by the constant beating from the ball, erosion from abrasives, corrosion, chipping, or flaking, the steel balls cannot seal the pump and there is unwanted water leakage. Further, there are many instances when water well pumps must be assembled and installed in a short amount of time such as in emergency situations and field operations using materials available in the given area and usually without electricity. The unique design of the present invention allows it to be made and used in a short amount of time and requires no electricity or adaptors to assemble which is in direct contrast to the prior art.

Efforts to eliminate the above-mentioned problems while providing a well pump which is inexpensive to manufacture and is reliable in operation have not been entirely successful and further improvements in such pumps have long been sought. It is to these ends that the present invention has been developed for use in water wells and oil wells.

SUMMARY OF THE INVENTION

Generally, the present invention contains a one-way standing valve holder and a one-way traveling valve holder. Contained within a shell of the standing valve holder are a nipple at the upper end and an intake tube at the lower end. A piston rod extends down from earth's surface to the traveling valve holder. At the lower end of the release tube is a piston. To form the water well pump, the piston end of the traveling valve holder is inserted into the nipple end of standing valve holder. Once inserted, the piston is aligned with a piston stop contained within the nipple. An elastic ball within the shell of the standing valve holder creates a one-way standing valve in the water well pump, and a hard ball within the piston of the traveling valve holder creates a one-way traveling valve in the water well pump. Surface equipment connected to traveling valve holder is used to reciprocate the traveling valve holder up and down using electric or manual power. During reciprocation, the one-way valves open and close at alternating intervals to allow water to flow through the valves to ports on the release tube. Water released from ports travels upward within the confines of the riser pipe, filling it with water. Additional pumping causes the water to flow out of the top end of the riser pipe, where it can be collected, and put in a bucket or other suitable container. The present invention may also be used in an oil well.

In view of the foregoing, an object of the present invention is to provide a novel water well pump that reduces water hammer when the pump is used or is stopped. This is accomplished with hydraulic damping using a damper ring and with a collar attached to the inner portion of the shell where the elastic ball of the one way standing valve is located and with labyrinthine water passages.

It is another object of the present invention to provide a novel water well pump that prevents water leakage when a seat for the elastic ball is corroded or damaged. The present elastic ball is elastic and molds into any damaged areas of the seat to prevent water leakage.

It is another object of the present invention to provide a novel water well pump that contains an elastic or elastic ball that increases long-term functionality of the pump as well as decreases maintenance required. The offset balcony seat and the twist notch allows for even wear around the elastic ball as the ball gradually rotates about two axes.

It is another object of the present invention to provide a novel water well pump that provides a multi-purpose support for the elastic ball. First, the support acts to underpin the elastic ball when it is at rest. Second, the support allows water to pass upward into the cylinder.

It is another object of the present invention to provide a novel water well pump that does not require adapters for connecting the piping components. A swaging process with solvent for the polymers is used to connect many of the components, which provides leak proof connections.

It is another object of the present invention to provide a novel water well pump with an automatic two axis ball rotator, which gradually rotates the ball so that it will last longer than the balls of the prior art.

It is another object of the present invention to provide a novel water well pump, which pumps with less force, less power, and less energy required to operate it by novel design, which does not require piston rings, nor piston cups nor any direct contact between the piston and the cylinder, held apart by the water space between the two.

It is another object of the present invention to provide a novel water well pump that is manually operable and operates quickly in the upward direction only and allows the user to rest as long as he/she wishes before pushing down slowly. This allows a single user to pump more water with this novel pump before becoming fatigued.

It is another object of the present invention to provide a novel water well pump that has a strong support for the elastic ball, which serves to underpin it while also permitting the free flow of pump water through it.

It is another object of the present invention to provide a novel water well pump that is not angularly distorted during operation.

It is another object of the present invention to provide a novel water well pump that can be made without electricity if desired. This makes the pump useful in situations where electricity is not available such as for developing countries, remote villages, cottages, camping, field operations, or any type of emergencies.

It is another object of the present invention to provide a novel water well pump that contains a gravel plug and intake tube to protect the pump components from corrosion and debris that may interfere with the operation of the pump.

It is another object of the present invention to provide a novel water well pump that prevents water entering inside the hollow piston rod and will not leak water out of the top of it. This is accomplished with a plug at the end of the joining tube or at the end of the ball stop.

It is another object of the present invention to provide a novel water well pump that is easy to manufacture with simple hand tools and commonly used construction materials, such as Schedule 40 PVC piping or ABS piping.

It is another object of the present invention to provide a novel water well pump, which provides a built in hydraulic damper for the vibrations of the ball.

It is another object of the present invention to provide a novel water well pump with a crude inexpensive riser pipe, which serves well to not only carry the water upward, but also serves as a good cylinder for the piston.

It is another object of the present invention to provide a novel water well pump, which provides a large, free flowing labyrinthine path for the water moving through, giving the benefit of reduced vibrations by utilizing the hydraulic damping of vibrations of any fluid in labyrinthine passageways.

It is another object of the present invention to provide a novel water well pump to precisely limit the ball travel to a few millimeters to obtain quicker closing of the valve.

It is another object of the present invention to provide a damping collar to reduce downward water flow to the underside of the elastic ball in its seat to reduce water hammer. Excessive flow caused by the design of the prior art increases water hammer.

It is another object of the present invention to provide a novel water well pump that can retain water for several months without leaking back through the valve once it is turned off. This would be beneficial for stripper wells.

These and other objects and advantages of the present invention will become apparent to one skilled in the art from the detailed description of the invention and the claims, with it understood that other configurations or substitutions of material may be used and are included within the scope of the claims of this invention.

DETAILED DESCRIPTION OF THE PREFERRED EMBODIMENT

Figure 1:
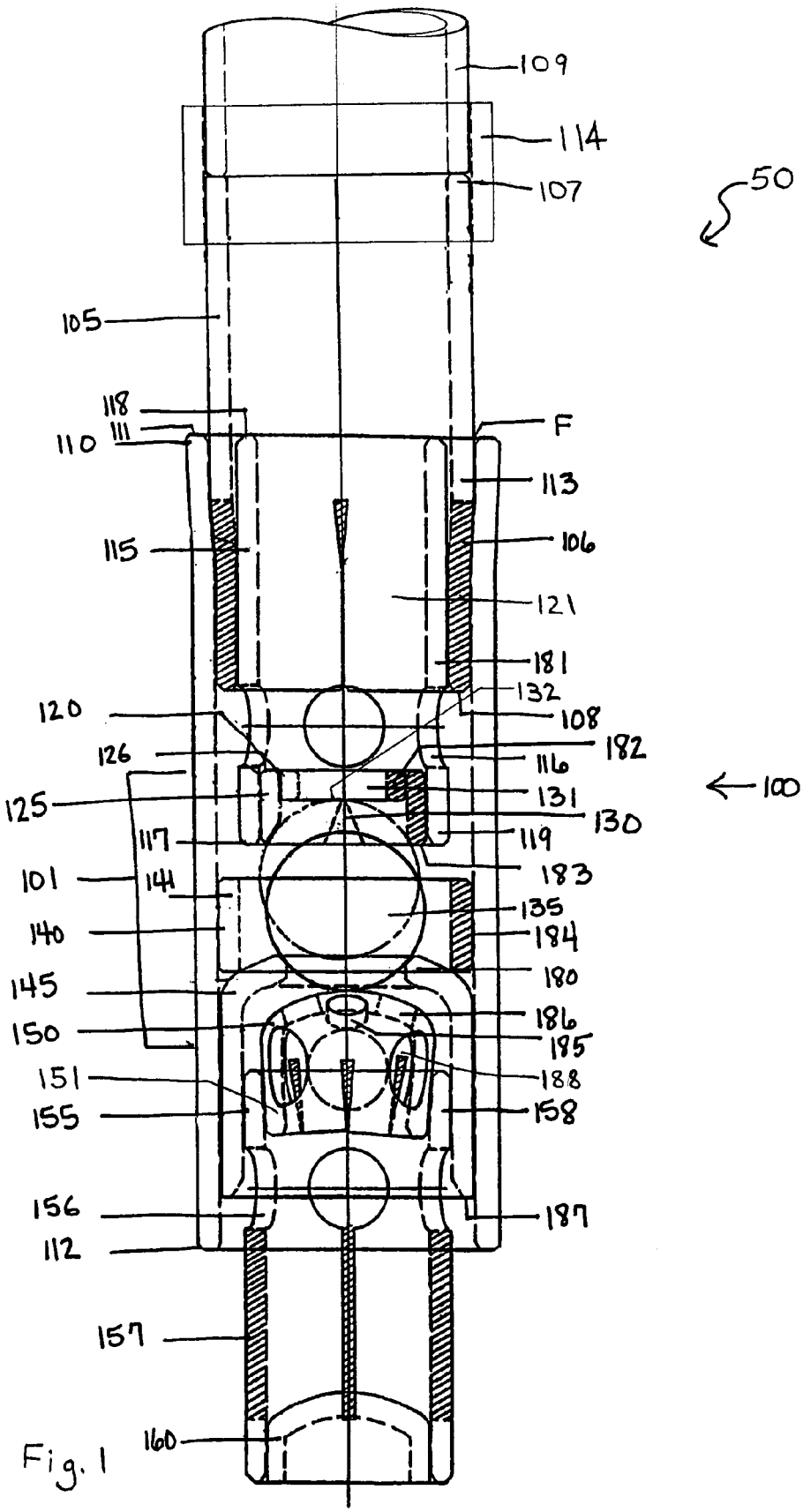
FIG. 1 is a cross section of the standing valve holder of the water well pump of the preferred embodiment of the present invention.
Figure 3:
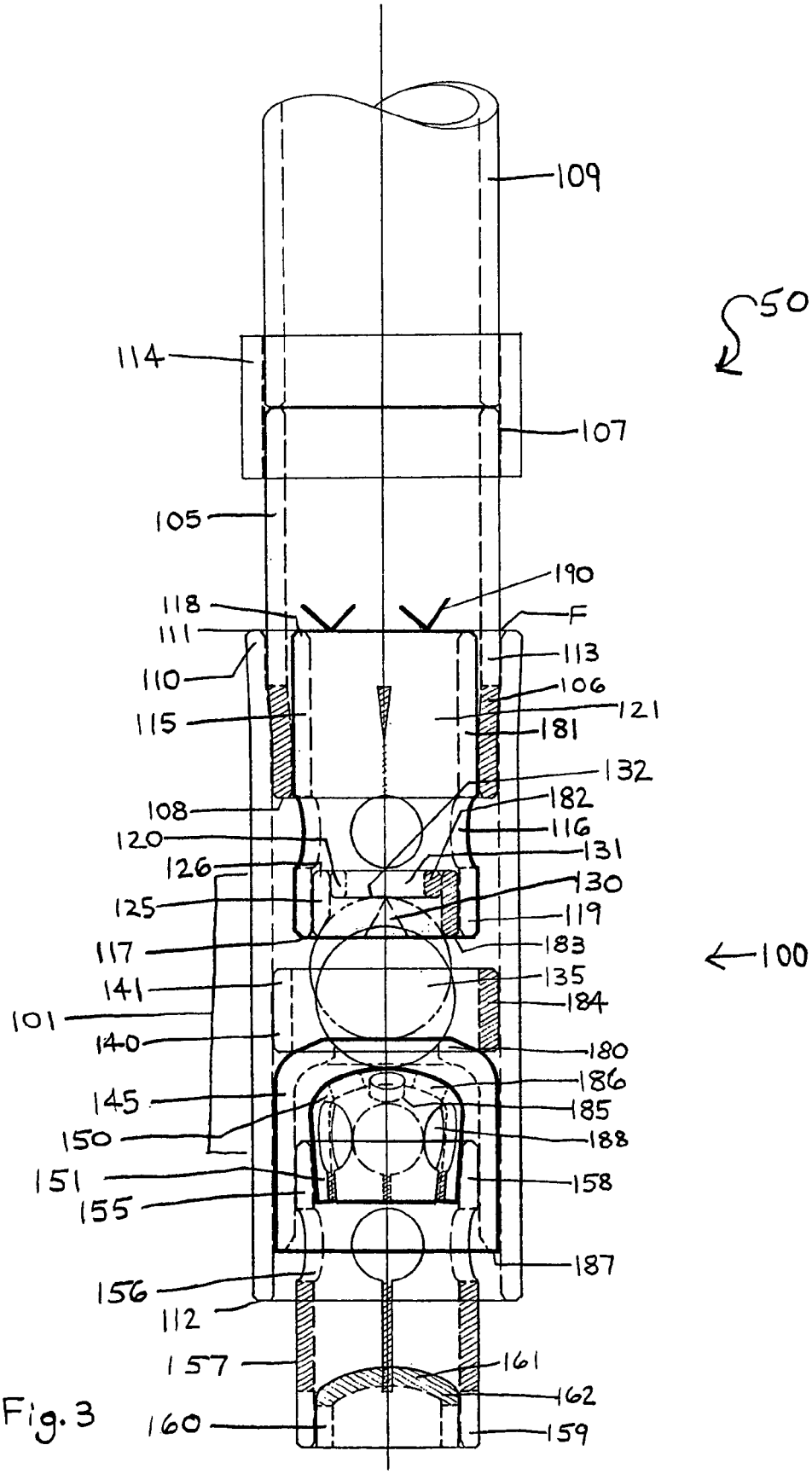
FIG. 3 is a cross section of the standing valve holder of the water well pump of the second embodiment of the present invention.

Referring to FIGS. 1 and 3, the standing valve holder of the water well pump of the preferred embodiment and of the second embodiment, respectively, of the present invention is shown. Referring to FIGS. 1 and 3, standing valve holder 100 contains a one-way standing valve 101. One-way standing valve 101 is composed of the lower end of piston stop 115, balcony seat 125, damper ring 120, twist notch 130, elastic ball 135, collar 140, main seat 145, and support 150, within shell 110.

Standing valve holder 100 contains an elongated shell 110 which is cylindrical having two open ends. Shell 110 is preferably fabricated of a high density polymer such as Schedule 40 PVC piping or ABS piping, but can be manufactured with any suitable material. In the preferred embodiment, shell 110 will have a 1½ inch inner diameter and will be about 13 cm in length. The two ends of shell 110 consist of an upper end 111 facing ground level and a lower end 112 facing the Earth's center when positioned for use. Within the upper end 111 of shell 110 is a pipe nipple 105, which is cylindrical having two open ends. Nipple 105 is preferably fabricated of a high density polymer such as Schedule 40 PVC piping or ABS piping, but can be manufactured with any suitable material. In the preferred embodiment, nipple 105 will have a 1¼ inch inner diameter and will be 9 cm or less in length. Further, nipple 105 has an upper end 107 and a lower end 108. Nipple 105 and shell 110 may have any desired inner diameter as long as nipple 105 is a size that does not fit into shell 110 without assistance.

Nipple 105 is force fitted into shell 110. This fit is provided without an adapter through the use of four slits 106 at the lower end 108 of nipple 105 represented as hatch marks on FIG. 1 and FIG. 3. Slits alone would leak water, which is not acceptable. However, the present four slits 106 are compressible and when compressed are encased within shell 110 and are sealed against inner wall of shell 110. The four opposing tabs 121 as shown slide within shell 110 to allow the compression to occur. Without the four slits 106, such compression would not occur. When the nipple 105 is fit into shell 110 and released, the four slits 106 will open slightly wedging nipple 105 within shell 110. Solvent welding is used for the polymer piping. Nipple 105 contains four slits 106, preferably 3 cm long or less. Four slits 106 allow the lower end 108 of nipple 105 to compress against the upper end 111 of shell 110, which reduces the effective diameter of the outside of nipple 105. This reduction in diameter allows nipple 105 to be inserted partway into shell 110 to point F. In embodiment of FIG. 3, wide "V" marks 190 are provides to assist the mechanic during assembly to point F. A strong hydraulic press is used to insert the nipple 105, having adhesive, into shell 110 with considerable force past four slits 106 and short section 113 on nipple 105 to point F. Nipple 105 and shell 110 are held together in a press until the adhesive applied has set. Four tabs 121 of nipple 105 have enough contact strength with the shell 110 to prevent nipple 105 from springing out of its engagement with shell 110.

The upper portion 181 of piston stop 115 is adjacent to the lower end 108 of nipple 105. Piston stop 115 has an upper end 118 placed at the same height as upper end 111 of shell 110 and a lower end 117 that extends below nipple 105 into the inner portion of shell 110. The upper end 118 of piston stop 115 connects to nipple 105 by pressing together with PVC solvent welding liquids. Piston stop 115 is preferably made of Schedule 40 PVC or ABS piping, but can be made with any suitable material. The upper end 118 of piston stop 115 serves to limit the lower end 226 of piston 225 of traveling valve holder 200 when traveling valve holder 200 is placed inside riser pipe 109. Riser pipe 109 being in turn connected to standing valve holder 100 via pipe coupling 114, with standing valve holder 100. Piston stop 115 together with balcony seat 125 functions as a ball cage at its lower end 117 by keeping elastic ball 135 near the center of the interior of shell 110, but slightly off center. The slightly off center placement of balcony seat 125 as shown in FIGS. 1 and 3 causes clockwise rotation of the elastic ball 135 of about 1 mm, during each stroke cycle of the pump action. This serves as a one axis ball turner to distribute wear evenly over the elastic ball 135 surface.

Balcony seat 125 serves to precisely limit the upward travel of elastic ball 135 in order to reduce vibrations. Balcony seat 125 is adjacent to the lower portion 119 of piston stop 115 on the interior side and extends to the lower end 117 of piston stop 115. Balcony seat 125 attaches to piston stop 115 by solvent welding. Balcony seat 125 is preferably constructed of Schedule 40 PVC piping or ABS piping. Balcony seat 125 is positioned within lower portion 119 of piston stop 115 by way of one slit 183. Damper ring 120 is adjacent to the upper portion 126 of balcony seat 125 on the interior side and extends only partway down balcony seat 125. Damper ring 120 is preferably constructed of Schedule 40 PVC piping or ABS piping, but can be constructed of any suitable material. Damper ring 120 is positioned within balcony seat 125 by way of one slit 182.

A twist notch 130 on balcony seat 125 directs turbulent flow of water differentially within standing valve holder 100 during down flow of water. During normal pump operation, piston 225 for this pump must be moved quickly upward, but is moved slowly downward. During one up stroke, a relatively larger amount of water, about ⅓ liter by actual test, passes up past elastic ball 135, but on the down stroke, only a tablespoon or two of water can pass by elastic ball 135 before it snaps shut. Twist notch 130 causes a differential pressure on one side of elastic ball 135, i.e., the side with twist notch 130. The differential pressure will cause the ball to pitch up during each stroke cycle. As elastic ball 135 rolls clockwise 1 or 2 mm in balcony seat 125 during up flow, the asymmetrical force during up flow and during down flow caused by twist notch 130 pitches elastic ball 135-upward. This causes an upward rotation of elastic ball 135 about 1/100 of a mm, making twist notch 130 act as another one axis ball turner. The axis of rotation is perpendicular to the first axis of rotation due to balcony seat 125. The combination acts together to cause elastic ball 135 to roll slightly and pitch slightly during each stroke cycle of the pump action. This acts together to rotate elastic ball 135 during normal operation for uniform wear around the surface of elastic ball 135. This allows elastic ball 135 to wear evenly over its surface to increase durability and reduce maintenance of water well pump 50.

Hydraulic damping is provided by damper ring 120, which acts much like an automotive shock absorber. The velocity of flow of liquid through the orifice 131 is retarded. Damper ring 120 is below ports 116 in piston stop 115. The orifice 131 of damper ring 120 restricts rapid flow of water during both upward and downward flow and creates turbulence of water on the side of the orifice 131 opposite the direction of flow. The retardation of water flow down through orifice 131 does not allow a heavy hit down on elastic ball 135, but instead is a light hit. Less water with less velocity hits down on upper surface 132 of elastic ball 135. More water velocity is diverted left and right through ports 116. Elastic ball 135 having a lighter downward hit is not able to bounce back as high as for a larger hit. Smaller bounce means smaller water hammer. This is a working solution to a significant water hammer problem. Early models of pumps with elastic balls bounce (hammer) so strongly that the bouncing ball continues to hammer until pumps empty themselves of all water. The features of this invention give test results that do not empty the pump of water, but rather quickly shut off any pump water that might escape downward. Restricted orifice 131 brings about increased lateral flow through ports 116 and reduces longitudinal flow of water. The loss of kinetic energy in the longitudinal flow causes elastic ball 135 to reduce its hit downward and this reduces bounce back. Therefore, damper ring 120 reduces what is commonly called water hammer or an unwanted noisy and shaking of the water well pump 50, during each cycle of the reciprocal stroke action.

Collar 140 is adjacent to shell 110 on the inner surface of shell 110. Collar is 140 is positioned within shell 110 by way of one slit 184. Collar 140 is preferably constructed of Schedule 40 PVC or ABS piping, but can be constructed of any suitable material. Collar 140 also helps to reduce water hammer. During the normal pumping of any reciprocal pump, there are moments of up flow and moments of down flow. During down flow, the water from ports 116 in piston stop 115 encounters the upper surface 141 of collar 140. Because of this, the water is unable to move straight downward to get underneath elastic ball 135. Therefore, the water is deflected laterally toward the center of standing valve holder 100 with turbulence caused by laterally opposing flows of water from the opposing side of standing valve holder 100. This lateral flow of water transforms the kinetic energy from longitudinal kinetic energy to lateral kinetic energy, which decreases the amount of fast moving water that can get under elastic ball 135 as elastic ball 135 seats itself in main seat 145. This transformation to lateral kinetic energy reduces water hammer by reducing the excess bouncing of elastic ball 135; collar 140 further increases the length of labyrinthine passageway to slow down the flowing water. With low water pressure under elastic ball 135 and high water pressure above elastic ball 135, any vibrations ("hammer") quickly reduce to null according to actual test results.

Elastic ball 135 is situated within the center of shell 110 within collar 140 creating the one-way standing valve 101. Elastic ball 135 is preferably made of an elastic rubber such as silicone rubber. Elastic ball 135 does not have to be made of a homogenous material. Therefore, for greater depths, elastic ball 135 may be made of steel with a rubber coating. Elastic ball 135 sits on top of main seat 145 over a top opening of main seat 145 formed by rounded side 180. Elastic ball 135 is flexible and can conform to a damaged main seat 145. Main seat 145 may be damaged from the constant impact of elastic ball 135, erosion from abrasives, corrosion, chipping, or flaking. Traditional steel balls would be unable to seal the standing valve holder 100 to prevent unwanted water leakage. However, elastic ball 135 will prevent unwanted water leakage because the water pressure pushes the soft, elastic material of elastic ball 135 into the damaged or chipped places of main seat 145. Therefore, the only leakage past elastic ball 135 will be individual molecules of water due to heat vibrations of molecules within the water.

Elastic ball 135 additionally requires support 150. The lower end 151 of support 150 is fitted within the upper end 158 of an intake tube 155. The upper portion 186 of support 150 has three orifices 185, but the exact number of orifices 185 is optional, for allowing the passage of water through the one-way standing valve 101. The sides of support 150 have three additional orifices 188, but the exact number of orifices 188 is optional, to allow easy passage of water upward. Intake tube 155 in turn is fitted within main seat 145. Support 150 connects to intake tube 155 by solvent welding of the polymers. Support 150 is preferably constructed of Schedule 40 PVC or ABS piping, but can be constructed of any suitable material. Support 150 is required to prevent elastic ball 135 from compressing itself due to its elasticity and from jamming itself tightly in the top opening of main seat 145. If elastic ball 135 were to force itself through the top opening of main seat 145 during pumping, the water well pump 50 would become completely inoperative. Therefore, support 150 serves to underpin elastic ball 135 when elastic ball 135 is at rest. Support 150 also allows water to pass through support 150. When water flow is upward, water flows upward through orifices 185, 188 of support 150, lifts ball, and flows up past the lifted elastic ball 135 and further upward through ports 116 and further upward through nipple 105 into riser pipe 109. When water flow is shut off, elastic ball 135 seals top opening of main seat 145. Therefore, support 150 functions as a superb brace for elastic ball 135 while also allowing easy flow of water upward through the many orifices 185, 188 of support 150, as shown in FIGS. 1 and 3.

The main functions of intake tube 155 are to provide a mechanism for straining out small bits of gravel and other debris from water well pump 50 and to provide a foundation for support 150. Intake tube 155 is adjacent to the bottom portion 187 of main seat 145 and extends below shell 110. Intake tube 155 attaches to main seat 145 by solvent welding of polymer in the usual way. Intake tube 155 is preferably constructed of Schedule 40 PVC or ABS piping, but can be constructed of any suitable material. The lower end 112 of shell 110 forms a shield over the four intake holes 156 on intake tube 155 thus creating a circular water channel 189 between lower end 112 of shell 110 and intake tube 155. This water channel 189 is narrow but long. The narrowness of it keeps gravel away from entering the larger intake holes 156 to protect the pump mechanisms from gravel, or other debris. The four intake holes 156 join with four slits 157 on intake tube 155 to form a continuous passage way for water into water well pump 50 shielded from debris by shell 110.

Gravel plug 160 is at the bottom end of intake tube 155. Gravel plug 160 is preferably constructed of Schedule 40 PVC or ABS piping and solvent welded in intake tube 155. The main function of gravel plug 160 is to prevent trash or other solid debris contained in the incoming water from entering the water well pump 50. Any sand that does get past gravel plug 160 will collect within intake tube 155 on top of gravel plug 160. Reciprocal sloshing action of the water during the stroke cycle of the pump action will allow excess sand to be expelled through four slits 157 out of water well pump 50.

Several differences from the preferred embodiment of standing valve holder 100 of FIG. 1 are shown in the second embodiment of FIG. 3. First, shell 110 will have the same inner diameter, but will be 12 cm long. Nipple 105 will have the same inner diameter but will be 7 cm long. Second, upper end 161 of gravel plug 160 contains slits 162. Slits 162 provide a connecting means to allow a force fit of gravel plug 160 into the lower end 159 of intake tube 155; solvent welding is used in the usual way. Slits 162 also provide a limited passageway for water into intake tube 155 while also preventing large debris from entering water well pump 50. Further, in line with point F on nipple 105 are two wide "V" marks 190 made in the shape of a pronounced "V" which provide location assistance to the mechanic when he is pressing the assembly together as he reaches point F. The pronounced "V" design is necessary to identify depth of engagement during pressing of components. During application of the solvent to nipple 105 up to the wide "V" marks 190, it dissolves the apex of the wide "V" marks 190, but the wide "V" allows the mechanic to extrapolate with his eyes the location of the apex of the "V" which disappeared during application of the solvent. This improvement serves to allow for exact placement of nipple 105 into shell 110 during normal assembly of water well pump 50.

Figure 2:
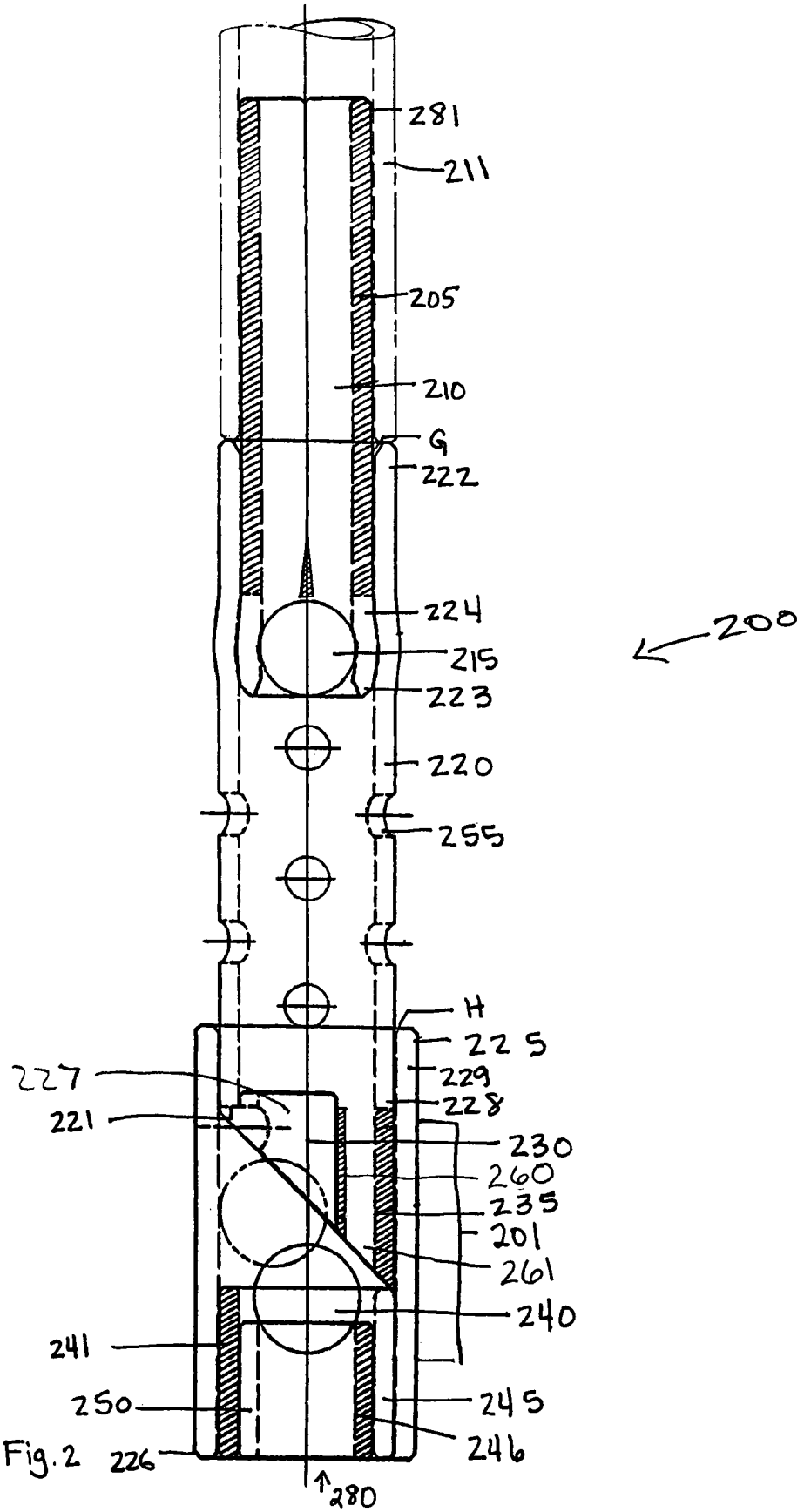
FIG. 2 is a cross section of the traveling valve holder of the water well pump of the preferred embodiment of the present invention.
Figure 4:
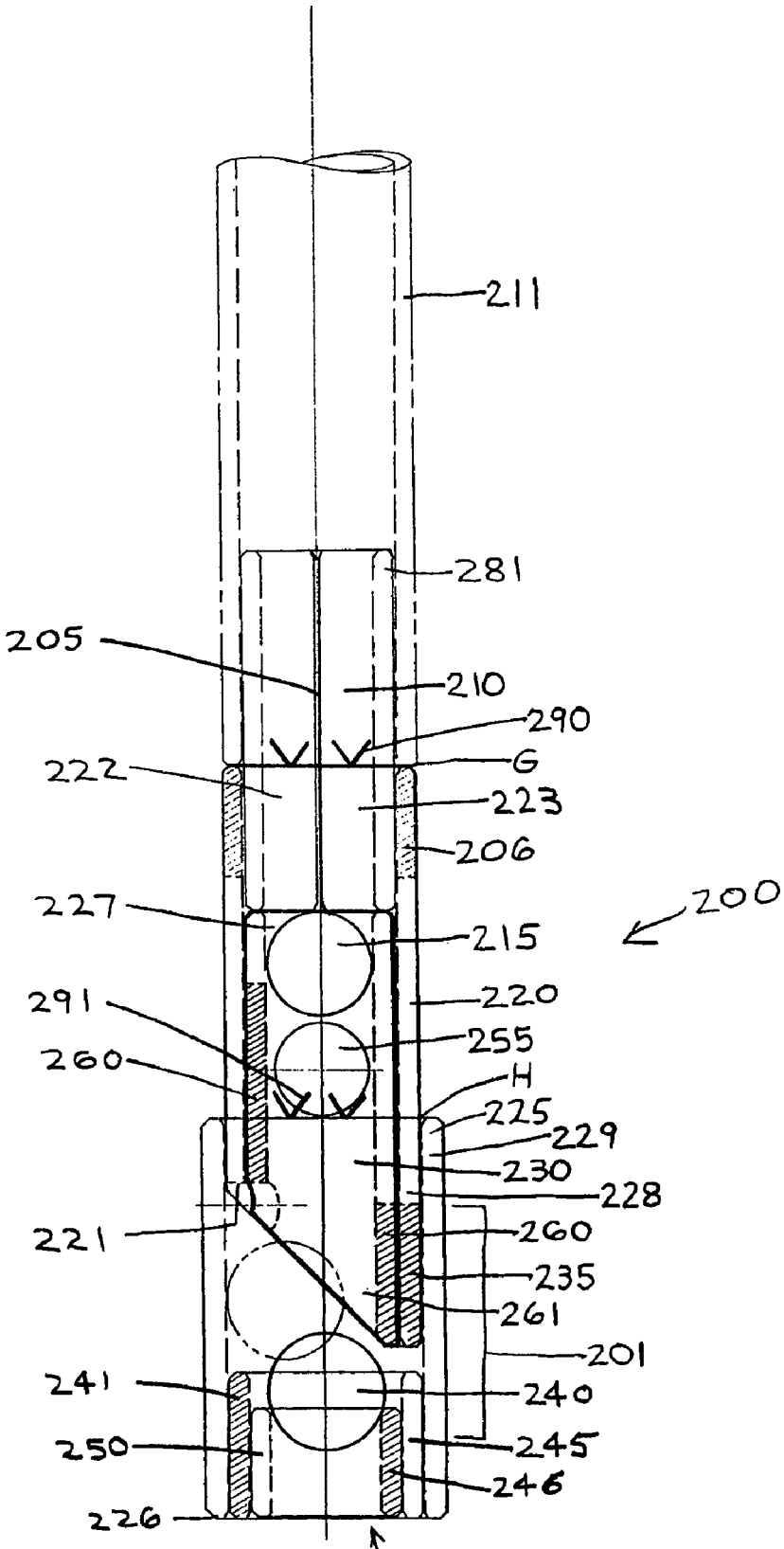
FIG. 4 is a cross section of the traveling valve holder of the water well pump of the second embodiment of the present invention.

Referring to FIGS. 2 and 4, the traveling valve holder 200 of the preferred embodiment and second embodiment, respectively, of the present invention are shown. In FIG. 2, the traveling valve holder of the water well pump of the preferred embodiment of the present invention is shown. Traveling valve holder 200 generally contains an elongated joining tube 210, an elongated release tube 220, and a piston 225. Release tube 220 is cylindrical with two open ends and preferably constructed of a high density polymer such as Schedule 40 PVC piping or ABS piping, but can be constructed of any suitable material. In the preferred embodiment, release tube 220 will have a ¾ inch inner diameter and will be 12.5 cm in length. The bottom end 221 of release tube 220 is cut at a 45° angle. Within release tube 220 is a shorter elongated joining tube 210. Joining tube 210 is cylindrical with two open ends and preferably fabricated of a high density polymer such as Schedule 40 PVC piping or ABS piping, but can be manufactured from any suitable material. In the preferred embodiment, joining tube 210 will have a ½ inch inner diameter. Joining tube 210 connects to the hollow piston rod 211 (shown in phantom line), which extends from the water well pump 50 to the surface equipment (not shown) used to reciprocate traveling valve holder 200 or it can be manually reciprocated by a human being. Release tube 220 and joining tube 210 may have any desired diameter as long as the diameter is mall enough to allow free passage of water upward between release tube 220, piston rod 211, and riser pipe 109. The upward flow of water is in the usual way of flow of water through riser pipe 109.

Joining tube 210 is force fitted with release tube 220. This fit is provided without an adapter through the use of slits 205 (FIG. 2) and slits 206 (FIG. 4). In FIG. 4, the two slits 205 of joining tube 210 are in a clock position 90 degrees away from the two slits 206 of release tube 220. Thus, the surface of joining tube 210 covers over the slits 206 to prevent water leak. The surface of release tube 220 covers over the slits 205 of joining tube 210 in this way, due to the 90 degree clocked position. The four slits 205, 206 are covered over and do not leak.

Slits alone would leak water, which is not acceptable. However, the present slits 205 are compressible and when compressed, are encased within piston rod 211 and are sealed against the inner wall of piston rod 211. The two opposing slits 205 as shown allow the compression to occur. Without the slits 205, such compression will not occur. The joining tube 210 contains four slits 205 in FIG. 2, and contains two slits 205 in FIG. 4. Slits 260 allow ball stop 230 to compress against the bottom end 221 of release tube 220 and bonding of FIG. 4 embodiment. Slits 205 allow joining tube 210 to compress against the upper end 222 of release tube 220, which reduces the effective diameter of the outside of joining tube 210. This reduction in diameter allows joining tube 210 to be inserted partway into release tube 220 to point G. Further, in line with point G on joining tube 210 in the FIG. 4 embodiment are two wide "V" marks 290 which provide location assistance to the mechanic when he is pressing the assembly together as he reaches point G. A strong hydraulic press is used to insert joining tube 210 into release tube 220 with solvent welding of the polymer material. A plug 215 is simultaneously mechanically bonded into the lower portion 223 of joining tube 210 in FIG. 4; this plug blocks unwanted water flow up the joining tube 210. In FIG. 4, plug 215 is pressed into upper end of ball stop 230. In both FIGS. 2, 4, plug 215 is installed with solvent on it. Upper end 222 of release tube 220 may have a bevel edge adjacent to joining tube 210 and a chamfer edge on the outside of release tube 220; bevel edges and chamfer edges may be used to facilitate pressing the parts together. Lower portion 223 contains a region 224 that does not contain slits in FIG. 2, so this region 224 would not be compressible. Plug 215 is preferably a small hard ball, such as a marble, but can be any suitable material. Plug 215 is bonded to joining tube 210 in three ways.

First, bonding occurs by friction. Region 224 is rigid and plug 215 can be popped into place using PVC solvent on it before insertion into release tube 220. Once joining tube 210 is fit into release tube 220, the tight fit holds the plug 215 into place. Second, bonding is due to mechanical interference of the swaged end of joining tube 210. As mentioned, slits 205 allow compression of the sides of joining tube 210 to allow pressing it into release tube 220 using solvent welding of the polymers. This is the third bonding. Wide "V" marks 290 assist the mechanic in assembling joining tube 210 into release tube 220 of FIG. 4; wide "V" marks 290 are used to show exact location on point G.

Bonding occurs by application of PVC solvent or other adhesive before and after plug 215 is inserted into joining tube 210. Joining tube 210, release tube 220, and plug 215 are held together in the hydraulic press until the PVC solvent has set. Piston rod 211 (shown in phantom line) is connected to upper end 281 of joining tube 210 and would be used to cause traveling valve holder 200 to reciprocate or stroke up and down. This reciprocation may be accomplished manually, with an electric motor, or by any other suitable means.

The bottom end 221 of release tube 220 is surrounded by a piston 225. During pump operation, piston 225 fits inside riser pipe 109. The fit of piston 225 inside riser pipe 109 is a slip fit similar to the slip fit of the piston and cylinder of an automobile engine (not shown) except piston 225 requires no piston rings and is a deliberate loose fit within riser pipe 109. Riser pipe 109 serves two functions: one as a conduit for upward flowing water and two, as the cylinder for piston 225. The main function of piston 225 is to provide a means for lowering the water pressure below piston 225 during rapid upward lift of piston 225, and raising the water pressure below piston 225 during low downward push of piston 225. This alternating pressure causes elastic ball 135 to alternately rise and fall and hard ball 240 to alternately fall and rise, in the usual manner of check valves, the process of which causes the water to move upward in the normal way through any pipe. Piston 225 is cylindrical with two ends and is force fit with release tube 220. Piston 225 is preferably constructed of Schedule 40 PVC or ABS piping, but can be constructed of any suitable material. Within piston 225 is a hard ball 240 providing the one-way traveling valve 201. Hard ball 240 can be made of glass, steel, or of any suitable material. Slits 235 are provided to allow placement of release tube 220 into piston 225. Slits 235 allow release tube 220 to compress against the upper end 229 of piston 225, which reduces the diameter of release tube 220 allowing it to fit within piston 225. This reduction in diameter allows release tube 220 to be inserted into piston 225 to point H. Further, in line with point H on release tube 220 are two wide "V" marks 291 of FIG. 4, which provided location assistance to the mechanic when he is pressing the assembly together as he reaches point H. A portion 228 of release tube 220 will be fit into piston 225 even though it contains no slits 235. Release tube 220 is self-aligning due to the tight fit of at least 1 cm of solid release tube 220 above the three slits 235 of FIG. 2 or one slit 235 of FIG. 4. This simultaneously provides a bevel of 45° that pushes hard ball 240 to the side every time traveling valve holder 200 is reciprocated. The 45° bevel serves to rotate hard ball 140 in the clockwise direction.

A ball stop 230 is connected to release tube 220 to provide angled movement of hard ball 240 and to stop further upward movement of hard ball 240. Ball stop 230 is connected to release tube 220 by solvent welding or other adhesive. Ball stop 230 is preferably constructed of Schedule 40 PVC or ABS piping, but can be constructed of any suitable material. Hard ball 240 is preferably made of a glass material such as in the "marble", a boy's or girl's toy, but can be made of any suitable material. Ball stop 230 can deflect hard ball 240 out of the path of flowing water while simultaneously providing four concurrent paths for flow: 1) a cut-a-way of 1 cm of the release tube 220 at the slit 235; 2) a ¼ inch diameter hole drilled through both the ball stop 230 and release tube 220, near the point located by the pointer of bottom end 221 of release tube 220, and connected by cut-a-way to the adjacent open space; 3) two creases, one on each side of hard ball 240 along the 45° cut angle; and 4) the inner diameter of ball stop 230 itself, which is open for the upward flowing water.

Hard ball 240 is positioned over a bushing 245 and a stool 250. Bushing 245 is adjacent to the inner portion of piston 225 directly below the bottom end 221 of release tube 220. Bushing 245 is force fit with piston 225 by way of one slit 241 and bonded with solvent welding or other adhesive. Bushing 245 is preferably constructed of Schedule 40 PVC or ABS piping, but can be manufactured from any suitable material. Stool 250 is adjacent to the inner portion of bushing 245 and is slightly shorter than bushing 245. Stool 250 is force fit with bushing 245 by way of one slit 246 and bonded in a like manner. Stool 250 is preferably constructed of Schedule 40 PVC or ABS piping, but can be constructed of any suitable material. Bushing 245 and stool 250 serve to support hard ball 240 and seal the one-way traveling valve 201. To achieve a perfect fit for hard ball 240, bushing 245 and stool 250 are modified with exact measurement slit 241 and exact measurement slit 246. Therefore, upon compression in piston 225, both bushing 245 and stool 250 will perfectly fit into piston 225 and will close up slit 241 and slit 246, and prevent unwanted leaks, and will hold with great strength with the bonding liquid used during manufacture and provides a secure fit to hard ball 240. The bottom ends of piston 225, busing 245 and stool 250 are aligned at the same point to form the bottom 280 of traveling valve holder 200.

Several differences from the preferred embodiment of the traveling valve holder 200 in FIG. 2 are shown in the second embodiment of FIG. 4. Release tube 220 contains two slits 206 which allow the force fit between release tube 220 and joining tube 210. Further, joining tube 210 extends down to the upper end 227 of ball stop 230 in FIG. 4, but not to upper end 227 of ball stop 230 in FIG. 2. The bottom end 261 of ball stop 230 is cut at a 45 degree angle in both embodiments of FIG. 2 and FIG. 4. Ball stop 230 contains slit 260 on bottom ends 261 to force fit with release tube 220. In addition, plug 215 is bonded inside ball stop 230 of FIG. 4 embodiment but not in ball stop 230 of FIG. 2 embodiment. Joining tube 210 of FIG. 4 ends at the top of ball stop 230 as shown in FIG. 4. In FIG. 4 embodiment, ports 255 are cut through both ball cage 230 and release tube 220 to allow water to flow out and upward within the riser pipe 109 in the usual way of water through a pipe. In both FIG. 1 and FIG. 3, nipple 105 is connected to riser pipe 109 using pipe coupling 114 with solvent welding. Pipe coupling 114 is shown shorter than actual size for purpose of diagram. Riser pipe 105 acts as the cylinder to piston 225, and riser pipe 105 serves the second function as conduit for the water, and serves the third function of being the structural support of the standing valve holder 100, supporting the weight of pipes and water inside.

The operation of the water well pump 50 is believed to be readily understandable to those skilled in the art from the foregoing description. However, briefly, water well pump 50 is submersed into a water well (not shown). Human manpower or surface equipment (not shown) reciprocates traveling valve holder 200 into standing valve holder 100 in an up and down manner using hollow piston rod 211 to transmit the motion. Piston rod 211 extends to the surface from water well pump 50. Reciprocation is allowed through piston 225 moving within riser pipe 109, which also serves as cylinder, upward 1 meter and downward to piston stop 115. When traveling valve holder 200 reciprocates slowly downward, elastic ball 135 will drop and close standing valve holder 100, and hard ball 240 will rise opening traveling valve holder 200 allowing water in riser pipe 109 to move up past hard ball 240. When traveling valve holder 200 reciprocates quickly upward, elastic ball 135 rises allowing water from intake tube 155 to move up past elastic ball 135 and enter nipple 105. During the next reciprocation downward, hard ball 240 again rises opening traveling valve holder 200 and water again flows up release tube 220 and out ports 255 and again into nipple 105 and riser pipe 109. The reciprocation of traveling valve holder 200 is repeated up and down to pump water from the ground, through riser pipe 109, filling riser pipe 109 until it is full, at which time additional pumping causes water to overflow out the top end of riser pipe 109, which water can be collected, and put into a bucket or other suitable container.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A water well pump comprising:

a first member having an exterior elongated shell surrounding a tube member and an intake tube;

a one way standing valve positioned above said intake tube within said first member for receiving well water, said one- way standing valve having an elastic ball supported by a first support means and maintained within said one-way standing valve by a blocking means, wherein said blocking means comprises a damper ring to reduce water hammering when said water well pump is in operation;

a piston stop within said first member positioned above said one-way standing valve and within said tube member to stop a piston when said water well pump is in operation;

a second member having said piston surrounding a release tube and a joining tube, said piston positioned at the bottom of said second member and movable axially within said tube member, said piston having an upper end adjacent said release tube and a lower end in axial communication with said piston stop when said water well pump is in operation;

a one way traveling valve positioned within said piston, said one way traveling valve having a ball supported by a second support means and maintained within said one-way traveling valve by an angular blocking means, wherein said angular blocking means comprises an angular ball stop designed to block said ball and roll it to the side of said one way traveling valve;

a plug positioned within said joining tube to block water from exiting said joining tube;

a plurality of release ports positioned on the exterior of said release tube to permit water to exit said release tube into water lines;

and a first sealing means used to fit said tube member within said shell comprising slits cut in the exterior of said tube member which compress under hydraulic force.

2. The water well pump of claim 1 wherein said one-way standing valve further comprises a twist notch positioned above said elastic ball to rotate said elastic ball to provide even wear.

3. The water well pump of claim 1 wherein said one-way standing valve further comprises a collar positioned around said elastic ball to prevent water hammer.

4. The water well pump of claim 1 wherein said angular ball stop has a 45 degree angle.

5. The water well pump of claim 1 further comprising a main seat with an orifice positioned above said first support means.

6. The water well pump of claim 1 wherein said second support means is comprised of a bushing surrounding a stool.

7. The water well pump of claim 1 further comprising a gravel plug positioned within said intake tube.

8. The water well pump of claim 1 wherein said blocking means further comprises a balcony seat positioned above said elastic ball, said balcony seat rotates said elastic ball to provide even wear.

9. The water well pump of claim 1 further comprising a second sealing means used to fit said joining tube within said release tube comprising slits cut in the exterior of said joining tube which compress under hydraulic force.

10. The water well pump of claim 1 wherein said shell, said tube member, said release tube, and said joining tube are constructed of Schedule 40 PVC piping.

11. The water well pump of claim 1 wherein said ball in said one way traveling valve is a glass marble.

12. The water well pump of claim 1 further comprising a third sealing means used to fit said release tube within said piston comprising slits cut in the exterior of said release tube which compress under hydraulic force.

13. The water well pump of claim 1 further comprising a fourth sealing means used to fit said bushing within said piston comprising slits cut in the exterior of said bushing which compress under hydraulic force.

14. The water well pump of claim 1 further comprising a fifth sealing means used to fit said stool within said bushing comprising slits cut in the exterior of said stool which compress under hydraulic force.

15. The water well pump of claim 1 further comprising a sixth sealing means used to fit said balcony seat within said piston stop comprising slits cut in the exterior of said balcony seat which compress under hydraulic force.

16. The water well pump of claim 1 further comprising a seventh sealing means used to fit said damper ring within said balcony seat comprising slits cut in the exterior of said damper ring which compress under hydraulic force.

17. The water well pump of claim 1 further comprising an eighth sealing means used to fit said collar within said shell comprising slits cut in the exterior of said collar which compress under hydraulic force.

18. A water well pump comprising:

a first member having an exterior elongated shell surrounding a tube member and an intake tube;

a one way standing valve positioned above said intake tube within said first member for receiving well water, said one-way standing valve having an elastic ball supported by a first support means and maintained within said one-way standing valve by a blocking means, wherein said blocking means comprises a damper ring to reduce water hammering when said water well pump is in operation and a balcony seat positioned above said elastic ball;

a piston stop within said first member positioned above said one-way standing valve and within said tube member to stop a piston when said water well pump is in operation;

a gravel plug positioned within said intake tube to block debris from entering said intake tube;

a second member having said piston surrounding a release tube and a joining tube, said piston positioned at the bottom of said second member and movable axially within said tube member, said piston having an upper end adjacent said release tube and a lower end in axial communication with said piston stop when said water well pump is in operation;

a one way traveling valve positioned within said piston, said one way traveling valve having a ball supported by a second support means, wherein said second support means is comprised of a bushing surrounding a stool, and said ball is maintained within said one-way traveling valve by an angular blocking means, wherein said angular blocking means comprises an angular ball stop designed to block said ball and roll it to the side of said one way traveling valve;

a plug positioned within said joining tube to block water from exiting said joining tube;

a plurality of release ports positioned on the exterior of said release tube to permit water to exit said release tube into water lines;

a first sealing means used to fit said tube member within said shell comprising slits cut in the exterior of said tube member which compress under hydraulic force; and a second sealing means used to fit said joining tube within said release tube comprising slits cut in the exterior of said joining tube which compress under hydraulic force.

19. The water well pump of claim 18 wherein said one-way standing valve further comprises a twist notch positioned above said elastic ball to rotate said elastic ball to provide even wear.

20. The water well pump of claim 18 wherein said one-way standing valve further comprises a collar positioned around said elastic ball to prevent water hammer.

* * * * *